US006089903A

United States Patent [19]

Stafford Gray et al.

[11] Patent Number: 6,089,903

[45] Date of Patent: Jul. 18, 2000

[54] ELECTRICAL CONNECTOR WITH AUTOMATIC CONDUCTOR TERMINATION

[75] Inventors: Ian James Stafford Gray, Nr. Winchester; Mike Duff, Reading, both of United Kingdom

[73] Assignee: ITT Manufacturing Enterprises, Inc., Wilmington, Del.

[21] Appl. No.: 09/020,364

[22] Filed: Feb. 9, 1998

[30] Foreign Application Priority Data

Feb. 24, 1997 [GB] United Kingdom ..... 9703752

[51] Int. Cl.[7] ..... H01R 4/24

[52] U.S. Cl. ..... 439/439; 439/578; 439/588

[58] Field of Search ..... 439/578, 376, 439/577, 579, 588, 587, 582, 583, 584, 585, 461, 462, 574–5, 439

[56] References Cited

U.S. PATENT DOCUMENTS

| | | | |
|---|---|---|---|
| 4,346,958 | 8/1982 | Blanchard | 339/117 |
| 4,854,893 | 8/1989 | Morris | 439/578 |
| 4,897,045 | 1/1990 | Dyck | 439/729 |
| 4,981,432 | 1/1991 | Kikuchi . | |
| 5,083,947 | 1/1992 | Dominique et al. . | |
| 5,183,412 | 2/1993 | Nagajuji | 439/578 |
| 5,277,613 | 1/1994 | Neward . | |
| 5,548,088 | 8/1996 | Gray et al. | 174/74 R |
| 5,863,220 | 1/1999 | Holliday | 439/584 |

FOREIGN PATENT DOCUMENTS

| | | |
|---|---|---|
| 0 234 780 | 2/1987 | European Pat. Off. . |
| 2 278 510 | 11/1994 | United Kingdom . |
| WO87/01244 | 2/1987 | WIPO . |
| WO96/09664 | 3/1996 | WIPO . |

*Primary Examiner*—Lincoln Donovan
*Attorney, Agent, or Firm*—Thomas L. Peterson

[57] ABSTRACT

An electrical connector includes a housing (12) and a coupling assembly (35) that has a mateable contact (32) at the front of the housing and a conductor-terminating coupling (34). The coupling has a pair of arms (38, 40) with jaws (48) that are biased toward an axis (37). A holder member (54) has a pair of projections (58, 60) with surfaces that hold the arms in a ready position wherein they have been resiliently deflected away from the axis. When a cable conductor (66) is inserted forwardly (F) through a bore (28) in the housing, the forward tip of the cable presses the coupling assembly forwardly. As the coupling assembly moves forward, the arms are released from the holder members, so the arms can move toward the axis and the jaws (48) on the arms can engage the cable conductor.

9 Claims, 4 Drawing Sheets

ELECTRICAL CONNECTOR WITH AUTOMATIC CONDUCTOR TERMINATION

BACKGROUND OF THE INVENTION

This invention relates to electrical connectors and especially, but not exclusively, to coaxial connectors.

The termination of a coaxial cable to a connector normally involves the preparation of the cable end so all layers of the cable are exposed, including the inner conductor, inner insulation, outer conductor in the form of a screen braid, and the outer insulation. The end of the inner conductor is normally terminated to a removed contact by soldering or crimping, with the inner contact then inserted and locked in place in the connector. Such assembly is time consuming and inconvenient, especially where it occurs in the field. A connector with a contact that could easily terminate to a wire such as the inner conductor of a coaxial cable, as well as easily terminating to the rest of the cable, would be of value.

SUMMARY OF THE INVENTION

In accordance with one embodiment of the present invention, an electrical connector is provided which can terminate to a wire or conductor, such as the inner conductor of a coaxial cable, by inserting the conductor forwardly into the connector housing. The connector includes a coupling assembly comprising a contact with a mateable end at the front end of the housing, and also comprising a coupling. The coupling is formed of sheet metal and has arms with jaws that can engage the conductor to terminate to it. The arms are resiliently deflected apart to a ready position, and held in that position by a holder member. When the conductor is inserted, the arms and their jaws are released from the holder member to allow the jaws to clamp to the conductor to terminate to it. The arms are preferably suddenly released to create a "snap" that indicates such termination. The coupling assembly, which includes the contact and the coupling that has the arms with jaws, its preferably slidably mounted within the housing. As a result, when the conductor is inserted, it pushes against a surface of the coupling to move it forwardly. A conductor that is part of a coaxial cable holds the contact in its forward position, with an inner insulation that surrounds the conductor being fixed in position within the housing by crimping to the rear of the housing and by also crimping to a cable outer insulation at a location rearward of the housing. Such crimping occurs when a metal ferrule is placed around the coaxial cable outer conductor as it lies around the housing.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
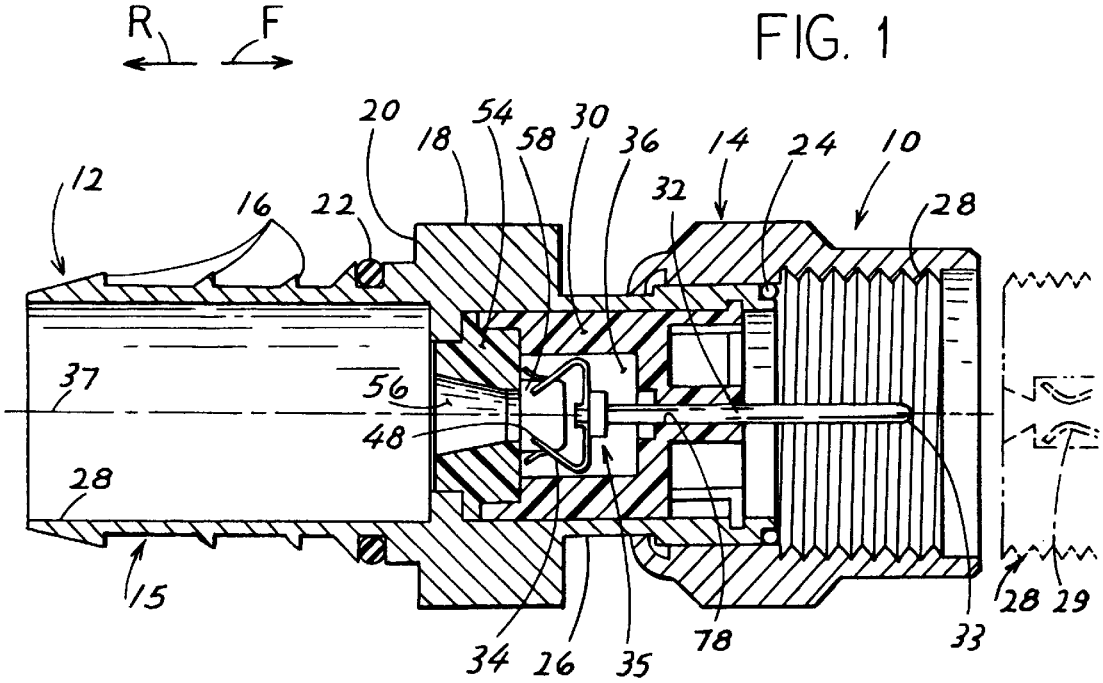
FIG. 1 is a sectional view taken along the axis of a coaxial connector constructed in accordance with the present invention, shown in an unterminated, ready state.

FIG. 1 illustrates an electrical connector 10 that has a substantially cylindrical metal housing 12 with a coupling nut 14. A rear portion 15 of the housing has radial outer projections 16 which help retain a screen braid outer conductor of a coaxial cable, as will be described later. A flange at 18 forms an abutment 20 to aid in mounting the connector. A sealing O-ring 22 lies in a radial groove in the body immediately rearward R of the flange. The forward end portion of the body includes a front sealing ring 24 that lies in a radial groove. A radial undercut 26 lying forward of the flange acts to retain the nut 14, the nut being rotatably mounted on the front portion of the housing and the rear end of the nut being swaged into the undercut 26. The front end of the housing is open and has an internal thread for connection to a mating connector device 28 with a socket contact 29, these being shown in phantom lines.

The connector has a bore 29 that extends forwardly into the rear end of the housing. A holder member 54 and an insulator 30 lie in the housing, with the holder member 54 having a through bore 56 extending from the bore 28 at the rear of the housing to a cavity 36 in the insulator.

Figure 7:
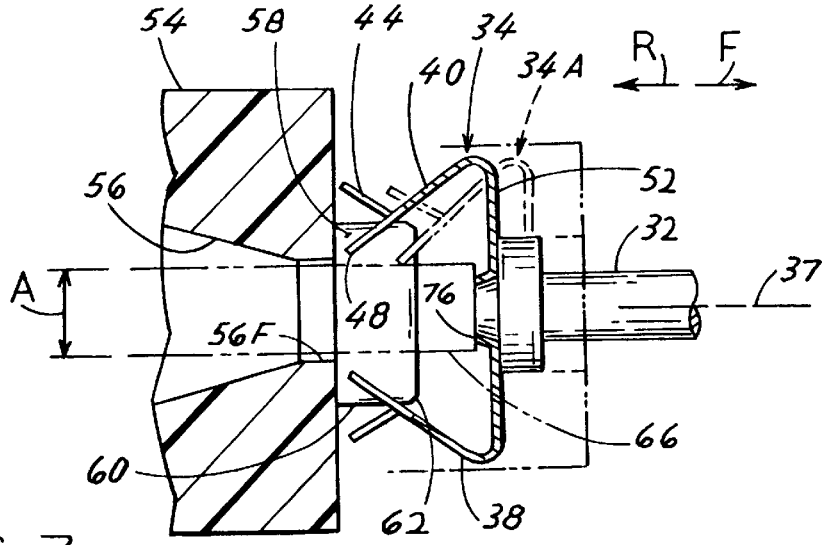
FIG. 7 is a view of a portion of FIG. 1, showing the coupling in its ready position, and showing, in phantom lines, the coupling in its terminated position.

A coupling assembly 35 which lies in the housing, includes a mateable contact 32, which is shown as being a pin contact with a mateable end 33 lying in the open front end of the housing in the coupling nut 14 thereof. The contact 32 lies at least partially in the housing front end, with the term "at least partially" meaning that either the entire contact lies in the housing or only part of the contact lies in the housing. The coupling assembly also includes a wire or conductor-terminating coupling 34 which is connected to the mateable contact 32. The coupling 34 lies in the cavity 36. The coupling is largely similar in appearance and operation to a "bulldog" clip, and has jaws 48 that can grasp an inserted conductor. FIG. 7 shows, in phantom lines, a cable conductor, central conductor 66 engaged by the coupling 34.

Figure 4:
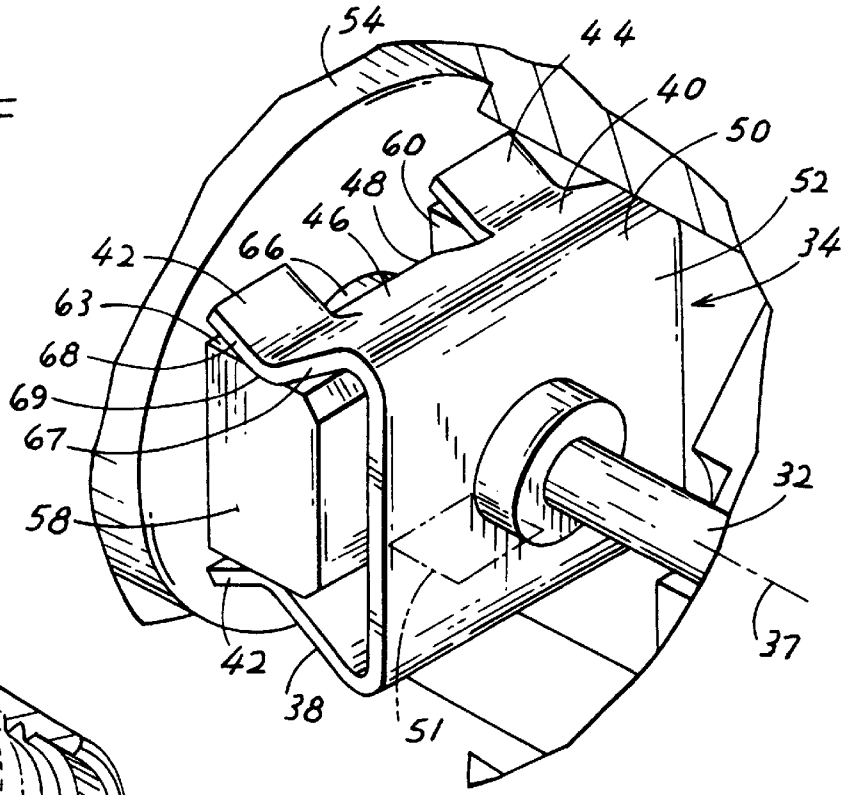
FIG. 4 is an enlarged isometric view of a portion of the connector of FIG. 3, shown in the ready state.
Figure 3:
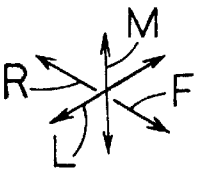
FIG. 3 is an isometric view of the connector of FIG. 1, in the unterminated, ready state.
Figure 3:
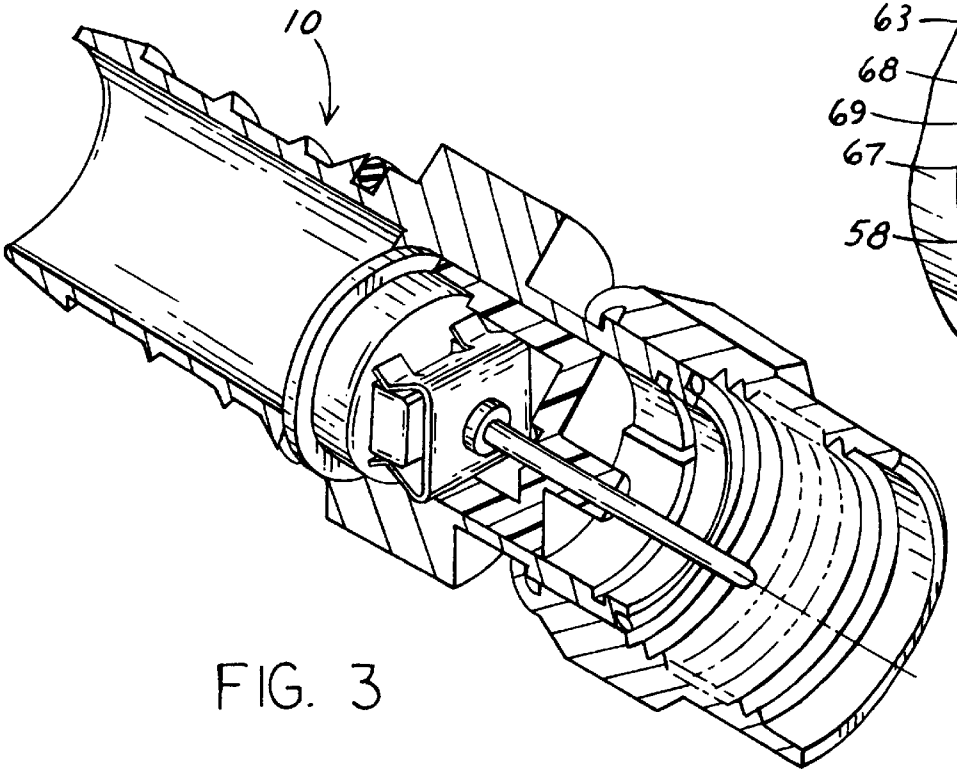

FIG. 4 shows that the coupling 34 is formed of sheet metal, and includes a base 52 extending largely perpendicular to an axis 37. The coupling includes a pair of longitudinally (along direction M) spaced arms 38, 40 extending from bends 50 at the top and bottom of the base. The coupling is symmetrical about a horizontal plane 51, with each arm having a pair of slots that form laterally (along direction L) spaced fingers including two positioning fingers 42, 44 and a jaw finger 46 between them. Each of the positioning fingers is bent to extend partially radially outwardly from the axis 37 in the ready position shown, while the jaw finger 46 extends towards the axis 37. The jaw finger 46 has a radially inner-rearward end forming a jaw 48. The term "jaw" is used only to indicate that the finger end forming the jaw 48 is intended to firmly engage a conductor. Each arm such as 40 has a proximal end 67 that joins to the base 52 through the bend 50, and has a distal end portion 68 that forms the slots that form the three fingers. As a result, when the positioning fingers 42, 44 are resiliently deflected away from the axis 37, the jaw finger 46 is also deflected away from the axis. The holder member 54 has a pair of projections or parts 58, 60 with surfaces 63 that hold the arms apart and away from the axis 37 in an unterminated or ready position of the connector.

Figure 6:
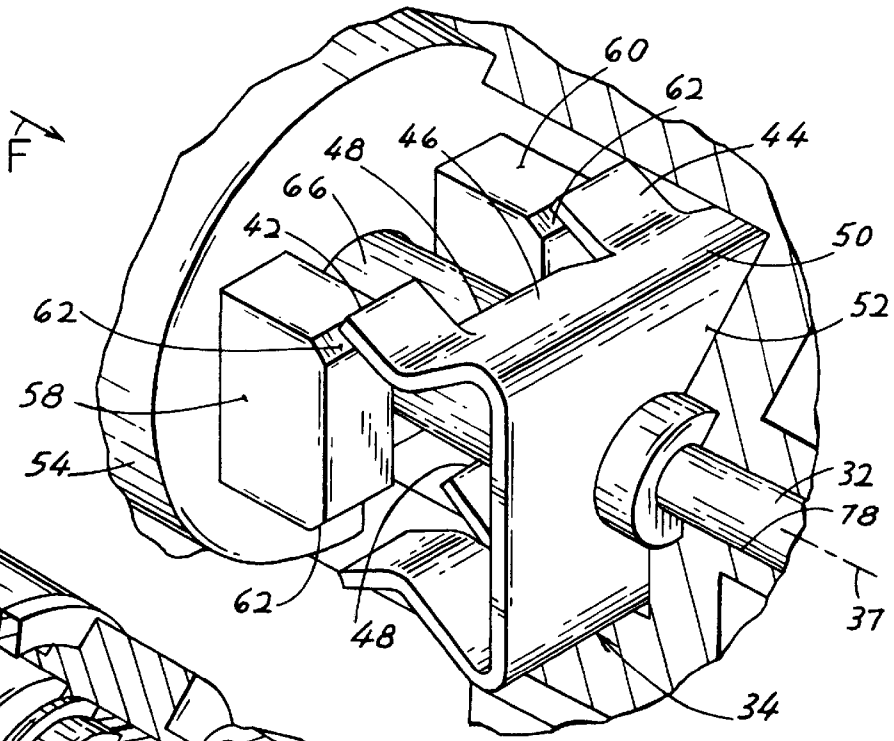
FIG. 6 is an enlarged view of a portion of the connector of FIG. 5 in the terminated, released state.
Figure 5:
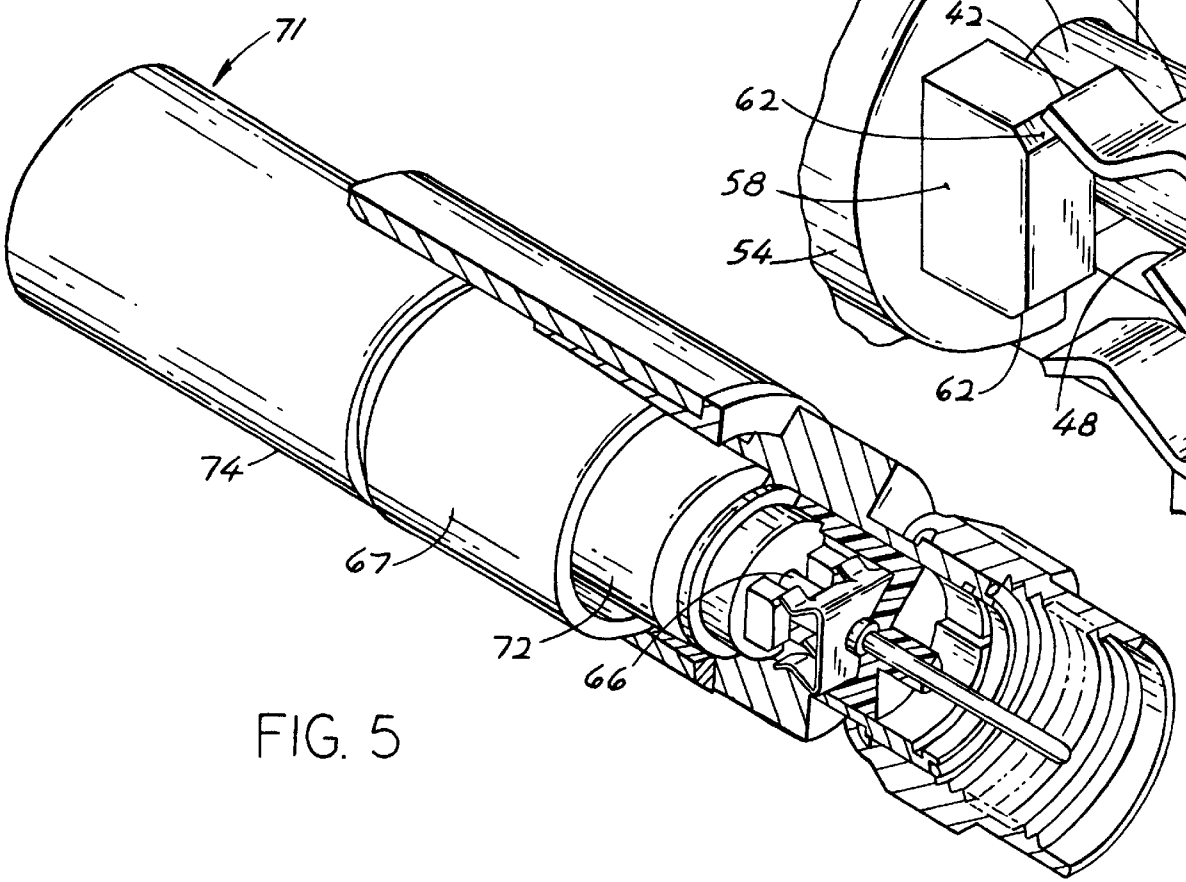
FIG. 5 is an isometric view of the connector of FIG. 2, shown in the terminated, released state.

FIG. 6 shows the coupling 34 after a wire or conductor 66 has been pushed forwardly F through the bore in the holder member 54, and against the coupling 34. Forward thrusting of the conductor 66 causes the coupling 34 to move forwardly, resulting in the positioning fingers 42, 44 being released from the holder member projections. This allows the jaw fingers 46 to move toward the axis 37 so the inner ends of the fingers, or jaws 48 engage the conductor 66. It is noted that the holder projections 58, 60 have tapered forward holder surfaces 62. Such tapered holder surfaces allow disengagement of the coupling 34 from the conductor 66, by forcefully pushing the coupling 34 forwardly, as by pushing the contact 32 forwardly. This is more easily accomplished where the coupling 34 and contact 32 are rigidly fixed together instead of being slidably electrically connected together. Once the radially inner end 69 of a positioning finger reaches the tapered surfaces, the arms rapidly move themselves toward the axis, creating a "snap" that is heard and felt. The jaws 48 then provide secure electrically conductive engagement with the conductor 66.

FIG. 7 shows the coupling 34 in its ready position in solid lines. The conductor 66 is shown in phantom lines after it has been thrust forward to move the coupling to its terminated position at 34A. It can be seen that the front end 56F of the bore 56 in the holder member 54 closely surrounds the conductor of predetermined diameter A (the difference in their diameters is preferably less than 0.5 mm) to avoid collapse of the conductor when rearward forces are applied to it during mating of the contact 32.

Figure 2:
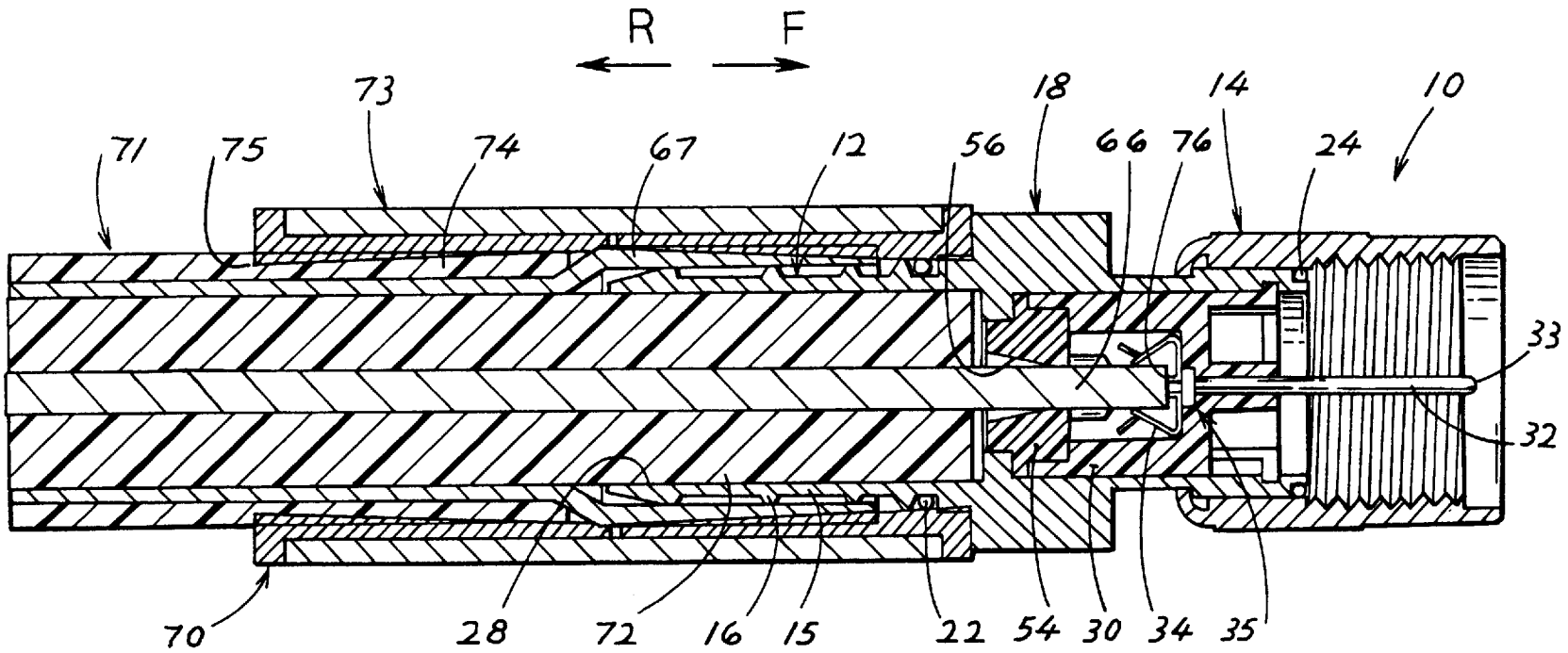
FIG. 2 is a sectional view similar to that of FIG. 1, but showing the connector terminated to a coaxial cable.

FIG. 2 illustrates a coaxial cable 71 with its central conductor 66 terminated to the coupling 34. The cable includes an inner cable insulator 72 that surrounds the central conductor 66, a braided screen outer cable terminal 67, and an outer insulator 74 that surrounds the outer cable terminal 67. To terminate the coaxial cable 71 to the connector 10, the forward cable end portion is prepared by stripping away different parts as shown, and with the outer terminal 67 usually spread backward around the outer insulator 74. The cable is then inserted into the bore 28 of the housing, with the conductor 66 guided in movement through the tapered through bore 56 of the holder 54, and against an abutting surface 76 on the coupling assembly. The technician pushes the cable forwardly at least until he hears or feels a snap. When the coupling 34 disengages from the holder member 54 and engages the conductor, the coupling continues forwardly until it encounters the front walls 76 of the cavity in the insulator 30.

After the central conductor 66 has been terminated to the coupling 34, the braided outer cable terminal 67 is spread around the housing rear portion 15. A ferrule assembly 69 comprising a tubular seal 70 with a metal ferrule 73 thereabout, is placed to lie around the housing rear portion 15 and extends rearwardly thereof. The metal ferrule 73 is then crimped, both at a location immediately around the housing rear portion 15, and at a location rearward thereof. The crimping at a rearward location at 75, causes the tubular seal 70 to bite into the outer insulator 74. The crimping of the metal ferrule 73 through the seal 70 to the housing rear portion 15 and to the outer insulator 74 assures a reliable connection of the coaxial cable to the housing.

As shown in FIG. 1, the pin contact 32 is slidably received in a narrow passage 78 of the insulator 30 of the housing, to slidably mount the coupling assembly to the housing. Any rearward R force on the contact mating end 33 is resisted by the central conductor 66.

The construction of the connector illustrated in the figures, enables termination of the central conductor 66 in a closed space (the cavity of the insulator 30) by simply pushing the cable forwardly into place. This makes termination very simple and results in the termination area being isolated from the environment. Release of the termination is also easily accomplished. It would be possible to have the coupling assembly 35 constructed so it is fixed in position, and have the holder member 54 slide along the axis, such as rearwardly, to allow the jaws to engage the conductor. In that case, the holder member would have a surface adjacent to the axis to allow a cable conductor to move the holder member forwardly to disengage it from at least one coupling arm that has a jaw. It also would be possible to have a holder member that slides perpendicular to the forward and rearward directions to release the jaw fingers, or even to have a holder member that turns to release the arms. However, in most cases such movement of the holder member would require additional steps and possibly access holes to move the holder member.

It would be possible to use more than two jaws, or even a single jaw that moves against the conductor while a nonmoveable support lies at a side of the conductor opposite to the jaw. However, applicant's use of a plurality of jaws increases the number of contacts and results in forces applied symmetrically about the conductor.

While the connector is shown for use in terminating a coaxial cable, it is possible to use the same invention to terminate to conductors or wires that are parts of cable (with one or more wires) that are not coaxial cables.

Thus, the invention provides a connector that allows termination to a conductor in a simple manner. The connector includes a coupling assembly with jaws that are resiliently deflected away from an axis along which the conductor is inserted, with the jaws then being released to engage the conductor. The coupling assembly can include a coupling formed from a piece of resilient sheet metal that includes a base extending primarily normal to the axis along which the conductor is inserted, and with a plurality of arms that are biased towards to the final conductor position. A holder holds the arms radially outward, but the coupling and/or the holder, and preferably the coupling, is moveable by the conductor to disengage the arms from the holder and allow them to engage the conductor in a snap action. The holder has surfaces positioned to spread apart the arms when the terminated coupling assembly is forced rearwardly.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector that can terminate to a conductor of a cable, said connector having a front end that can detachably mate to a connector device that has a mateable contact member, comprising:

a housing which has open front and rear ends;

a coupling assembly that lies in said housing and that includes a contact lying at least partially in said housing front end and positioned to mate with said contact member of said connector device;

said coupling assembly including a coupling that is connected to said contact, said coupling having a plurality of jaws biased toward an axis;

a holder member lying within said housing and having a holder part that engages said coupling and holds said jaws apart in a ready position to allow said cable conductor to move along said axis between said jaws, with said coupling being disengageable from said holder part to allow said jaws to move toward each other under the force of said bias, so said jaws can engage said cable conductor under the force of said bias to provide secure electrically conductive contact between said jaws and said cable conductor under the force of said bias.

2. The electrical connector described in claim 1 wherein:

said coupling includes a piece of resilient sheet metal that includes a base connected to said contact and with said piece of sheet metal including a plurality of arms extending from said base;

each of said arms has a proximal portion extending from said base and a distal portion extending from said proximal portion, with said distal portion of each of said arms having a plurality of fingers including a jaw finger that forms one of said jaws and a positioning finger;

said coupling is moveable parallel to said axis relative to said holder member from said ready position to a terminate position wherein said jaws have moved closer together than in said ready position, and in said ready position said positioning fingers lie against said holder member to hold said jaw fingers away from a conductor extending along said axis, but said positioning fingers being positioned to disengage from said holder member, when said coupling moves parallel to said axis away from said ready position, to allow said jaw fingers to move closer to said axis and engage said conductor.

3. The electrical connector described in claim 2 wherein:

said coupling has a surface lying adjacent to said axis to be pushed forwardly by said conductor.

4. An electrical connector for terminating to a conductor of predetermined radius, comprising:

a housing which has a front end that is open;

a coupling assembly that lies in said housing, said coupling assembly including a contact with a mateable end lying at least partially in said housing front end and also including a coupling;

said coupling is formed of sheet metal and has at least one arm with a jaw end lying in a ready position radially outward of a conductor axis by at least said predetermined radius, said arm being resiliently deflectable away from said axis to move said jaw end to said ready position, and said arm being resiliently biased toward a position wherein said jaw end tends to lie closer to said axis than said predetermined radius;

said housing including a bore that is open along said axis from the rear of said housing to a position forward of said jaw end, to allow said conductor to be pushed along said bore;

a holder member lying in said housing and holding said arm in a resiliently deflected position away from said axis wherein said jaw lies in said ready position;

of said holder member and said coupling, one of them is moveable to release said arm from said holder member and allow said arm to move away from said ready position and thereby allow said jaw end to move closer to said axis and engage said conductor.

5. The electrical conductor described in claim 4 wherein:

said coupling is moveable forwardly along said axis, and said coupling has a generally rearwardly-facing surface positioned to be pressed forwardly by said conductor until said arm is released from said holder member.

6. The electrical connector described in claim 4 wherein:

said coupling is fixed to said contact, and they are slidable together along said axis.

7. The electrical connector described in claim 4 wherein:

said piece of sheet metal of which said coupling is formed, includes a base that lies primarily in a plane that is normal to said axis and that has opposite base sides that lie on opposite sides of said axis, and said at least one arm comprises a pair of arms that each is integral with a different one of said opposite sides of said base, with each arm having a proximal end that forms a bend and that merges with a side of said base and with each arm having a distal end portion that has at least one slot that divides the distal end portion into a jaw finger that forms one of said jaw ends and a positioning finger that engages said holder member.

8. The electrical connector described in claim 4 wherein:

said coupling assembly is slidable along said axis;

said holder member has a bore part with a front portion that closely surrounds said conductor in said terminate position, to support said conductor against collapse when a rearward force is applied to said coupling assembly.

9. An electrical connector that is terminatable to a conductor, comprising:

a housing with open front and rear ends, with said rear end having a bore for passing said conductor in movement forwardly along an axis to a fully inserted position;

a coupling assembly lying in said housing and including a contact having a portion lying at said housing front end and also including coupling means with at least one arm that includes a jaw end that can move toward said axis to engage said conductor and that is resiliently biased toward said axis to firmly engage a conductor in said fully inserted position;

holder means lying in said housing and having a holder surface for engaging said at least one arm and holding said at least one arm so said jaw end is held away from the position of said conductor in said fully inserted position, with at least one of said means being moveable to release said at least one arm from said holder surface.

* * * * *